US008231290B2

(12) United States Patent
Katsumori

(10) Patent No.: US 8,231,290 B2
(45) Date of Patent: Jul. 31, 2012

(54) APPARATUS AND METHOD FOR CONTROLLING CUTTING LENGTH IN AN IMAGE RECORDING APPARATUS

(75) Inventor: Toshiharu Katsumori, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 124 days.

(21) Appl. No.: 12/885,689

(22) Filed: Sep. 20, 2010

(65) Prior Publication Data

US 2011/0008092 A1 Jan. 13, 2011

Related U.S. Application Data

(63) Continuation of application No. PCT/JP2009/001117, filed on Mar. 12, 2009.

(30) Foreign Application Priority Data

Mar. 28, 2008 (JP) ..... 2008-087265

(51) Int. Cl.
*B41J 11/70* (2006.01)
*B65H 35/06* (2006.01)

(52) U.S. Cl. ..... 400/621; 83/312; 83/236; 83/241; 83/403.1

(58) Field of Classification Search ..... 400/621; 83/336, 235, 236, 241, 403.1, 363, 312
See application file for complete search history.

(56) References Cited

U.S. PATENT DOCUMENTS 2,315,976 A * 4/1943 Method ..... 83/336
3,083,602 A * 4/1963 Obenshain ..... 83/75
4,305,317 A * 12/1981 Seragnoli ..... 83/336
4,809,573 A * 3/1989 Welch ..... 83/37
5,065,992 A 11/1991 Crowley
5,122,964 A * 6/1992 Hayashi et al. ..... 700/167
2003/0089209 A1* 5/2003 Brueckel et al. ..... 83/76.6
2010/0166482 A1* 7/2010 Gocho ..... 400/621

FOREIGN PATENT DOCUMENTS

JP 04-251074 A 9/1992
JP 05-064925 A 3/1993
JP 10-028198 A 1/1998
JP 2003-237193 A 8/2003

OTHER PUBLICATIONS

International Search Report and Written Opinion dated May 26, 2009 (in English) in counterpart International Application No. PCT/JP2009/001117.

* cited by examiner

*Primary Examiner* — Daniel J Colilla
(74) *Attorney, Agent, or Firm* — Holtz, Holtz, Goodman & Chick, P.C.

(57) ABSTRACT

An image recording apparatus includes a conveying unit for conveying a continuous medium, on which an image is recorded by an image recording unit, with a predetermined tension and speed, a cutting unit having a cut roller and an anvil roller, which are arranged to face each other in order to be able to cut the continuous medium and rotate with a predetermined rotation number, a leading unit having a pair of leading rollers that are arranged between the conveying unit and the cutting unit and nip and lead the continuous medium to the cutting unit, and a controlling unit for performing a control for temporarily suspending the pair of leading rollers, for leading the continuous medium to be cuttable into a short cut paper sheet shorter than a normal sheet.

8 Claims, 10 Drawing Sheets

APPARATUS AND METHOD FOR CONTROLLING CUTTING LENGTH IN AN IMAGE RECORDING APPARATUS

CROSS-REFERENCE TO RELATED APPLICATIONS

This is a Continuation Application of PCT Application No. PCT/JP2009/001117, filed Mar. 12, 2009, which was not published under PCT Article 21(2) in English.

This application is based upon and claims the benefit of priority from the prior Japanese Patent Application No. 2008-087265, filed Mar. 28, 2008, the entire contents of which are incorporated herein by reference.

FIELD

The present invention relates to an image recording apparatus for recording an image by establishing ink on a recording medium such as paper, a film or the like, and to a controlling method thereof.

BACKGROUND

Image recording apparatuses for recording a color image by jetting ink onto a continuous recording medium, such as paper, a film or the like, wound in the form of a roll, or onto a recording medium (a cut paper sheet) cut in advance in a predetermined size are known.

For a cut paper sheet, such image recording apparatuses record, for example, a different content image onto one recording medium that forms each page while conveying the recording medium at a speed as fast as several tens to several hundreds m/min. Moreover, continuous paper on which images are recorded is cut into pages and ejected.

Here, various methods are known as a method for sorting paper sheets cut in a predetermined length for each job. For example, a method for ejecting a paper sheet by offsetting the paper sheet to be ejected to a stacker, or a method for putting a mark on an end portion of a cut paper sheet is executed.

These ejection methods have a problem in that paper sheets are misaligned if the number of paper sheets of one job is large or if many paper sheets are desired to be stacked at one time.

As a solution to this problem, for example, Japanese Laid-open Patent Publication No. HEI5-64925 discloses a technique of enabling paper sheets to be easily sorted by inverting the orientation of printed data.

SUMMARY

An image recording apparatus in one aspect of the present invention includes: a conveying unit for conveying a continuous medium, on which an image is recorded by an image recording unit, with a predetermined tension and speed; a cutting unit having a cutting side rotator and a receiving side rotator, which are arranged to face each other in order to be able to cut the continuous medium and rotate with a predetermined rotation speed; a leading unit having a pair of leading rotators that are arranged between the conveying unit and the cutting unit and nip and lead the continuous medium to the cutting unit; and a controlling unit for performing a control for temporarily suspending or decelerating the pair of leading rotators to temporarily reduce an amount of the continuous medium led to the cutting unit, for leading the continuous medium in a size of a short cut paper sheet shorter than a normal cut size, for thereafter reactivating or accelerating the pair of leading rotators at predetermined timing to increase the amount of the continuous medium led to the cutting unit, and for leading the continuous medium in a size of a long cut paper sheet longer than the normal cut size.

A controlling method of an image recording apparatus in another aspect of the present invention includes: a conveying step of conveying a continuous medium, on which an image is recorded by an image recording unit, with a predetermined tension and speed; a cutting step of cutting the continuous medium with a cutting side rotator and a receiving side rotator, which are arranged to face each other in order to be able to cut the continuous medium and rotate with a predetermined rotation number; and a leading step of nipping and leading the continuous medium to a cutting unit with a pair of leading rotators that are arranged between a conveyance position in the conveying step and a cut position in the cutting step, wherein the pair of leading rotators is temporarily suspended or decelerated to temporarily reduce an amount of the continuous medium led to the cutting unit, the continuous medium is led and cut in a size of a short cut paper sheet shorter than a normal cut size, the pair of leading rotators is thereafter reactivated or accelerated at predetermined timing to increase the amount of the continuous medium led to the cutting unit, and the continuous medium is led and cut in a size of a long cut paper sheet longer than the normal cut size.

DESCRIPTION OF EMBODIMENTS

Embodiments according to the present invention are described below with reference to the drawings.

Figure 1:
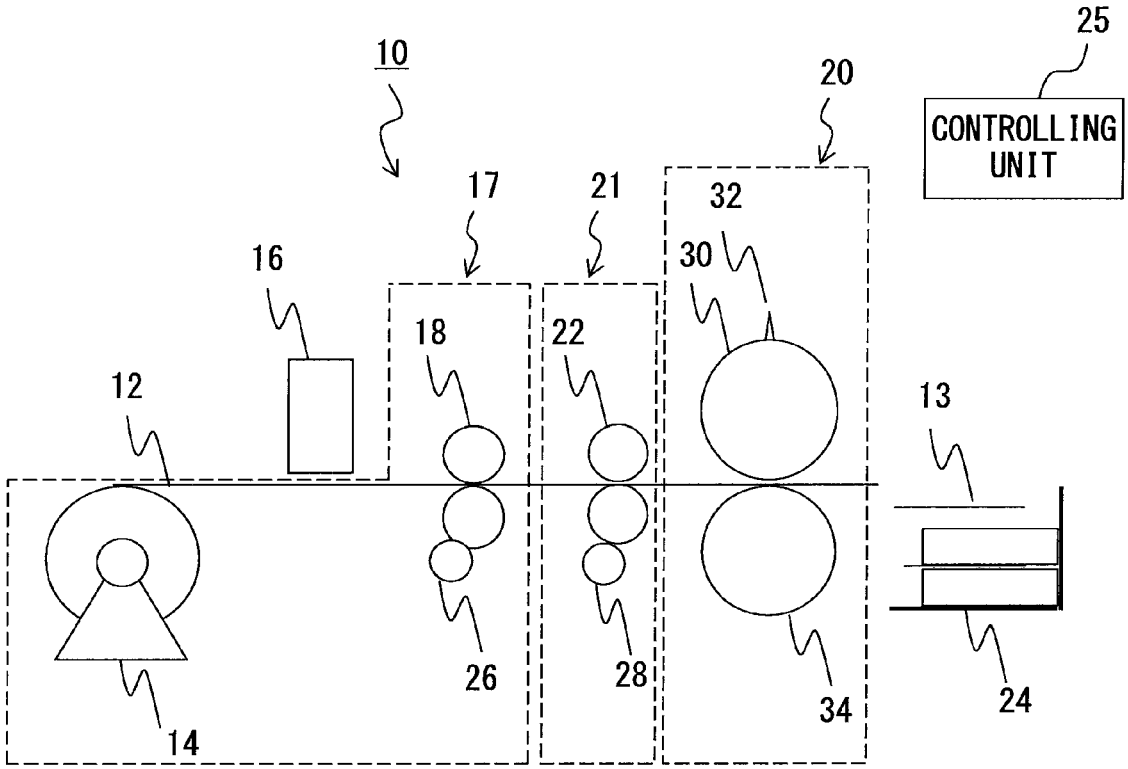
FIG. 1 illustrates an entire configuration of an image recording apparatus according to an embodiment.

FIG. 1 illustrates an entire configuration of an image recording apparatus according to an embodiment.

The image recording apparatus 10 includes a medium feeding unit 14 for accommodating a continuous recording medium 12 in the form of a roll, an image recording unit 16 for recording an image on the recording medium 12, a conveying unit 17 for conveying the recording medium 12, on which the image is recorded by the image recording unit 16, with a predetermined tension and speed, a cutting unit 20 for cutting the recording medium 12 in a predetermined length, a leading unit 21 arranged between the conveying unit 17 and the cutting unit 20, and a controlling unit 25 for controlling the entire apparatus.

A paper stacker 24 for stacking cut paper sheets 13 cut by the cutting unit 20 is provided at a stage succeeding the cutting unit 20.

The conveying unit 17 has a nip roller pair 18, 18 for nipping and conveying the continuous recording medium 12 toward a conveyance downstream. The nip roller pair 18, 18 is driven by a driving motor 26. The recording medium 12 is conveyed to the conveyance downstream by the nip roller pair 18, 18 with a predetermined tension.

The cutting unit 20 has a cut roller 30 as a cutting side rotator, and an anvil roller 34 as a receiving side rotator. The cut roller 30 and the anvil roller 34 are arranged to face each other in order to be able to cut the recording medium 12, and rotate with a predetermined number of rotations. An outer surface of the cut roller 30 is provided with a cut blade 32, which cuts the recording medium 12.

The leading unit 21 has a leading roller pair 22, 22 as a pair of leading rotators that are arranged between the conveying unit 17 and the cutting unit 20 and nip and lead the recording medium 12 with a tension smaller than a tension of the conveying unit 17. The leading roller pair 22, 22, is driven by a driving motor 28.

The controlling unit 25 performs a control for temporarily suspending or decelerating the leading roller pair 22, 22 to reduce an amount of the recording medium 12 led to the cutting unit 20, for leading the recording medium 12 in a cut size shorter than a normal cut size, for thereafter reactivating or accelerating the leading roller pair 22, 22 at predetermined timing to increase the amount of the recording medium 12 led to the cutting unit 20, and for leading the recording medium 12 in a cut size longer than the normal cut size.

In the above described configuration, the recording medium 12 is accommodated by the medium feeding unit 14 by being wound in the form of a roll. A back tension is applied to the rolled recording medium 12 by a friction applying mechanism not illustrated. The nip roller pair 18, 18 conveys the recording medium 12 while keeping the conveyance speed of the recording medium 12 constant. On the recording medium 12 thus conveyed, the image recording unit 16 records an image.

In this embodiment, a rotary cutting unit 20 is used as a method for cutting continuous paper in predetermined printing units. With the cutting unit 20, the cut blade 32 is pressed against the anvil roller 34 side by rotating the cut roller 30 and the anvil roller 34 at a constant speed that is synchronous with the conveyance speed of the recording medium 12, so that the recording medium 12 is cut in a predetermined paper sheet size.

The controlling unit 25 controls driving of the image recording unit 16, the conveying unit 17, the cutting unit 20 and the like upon receipt of an image recording instruction issued, for example, from a higher-order device (personal computer or the like) not illustrated.

Figure 2:
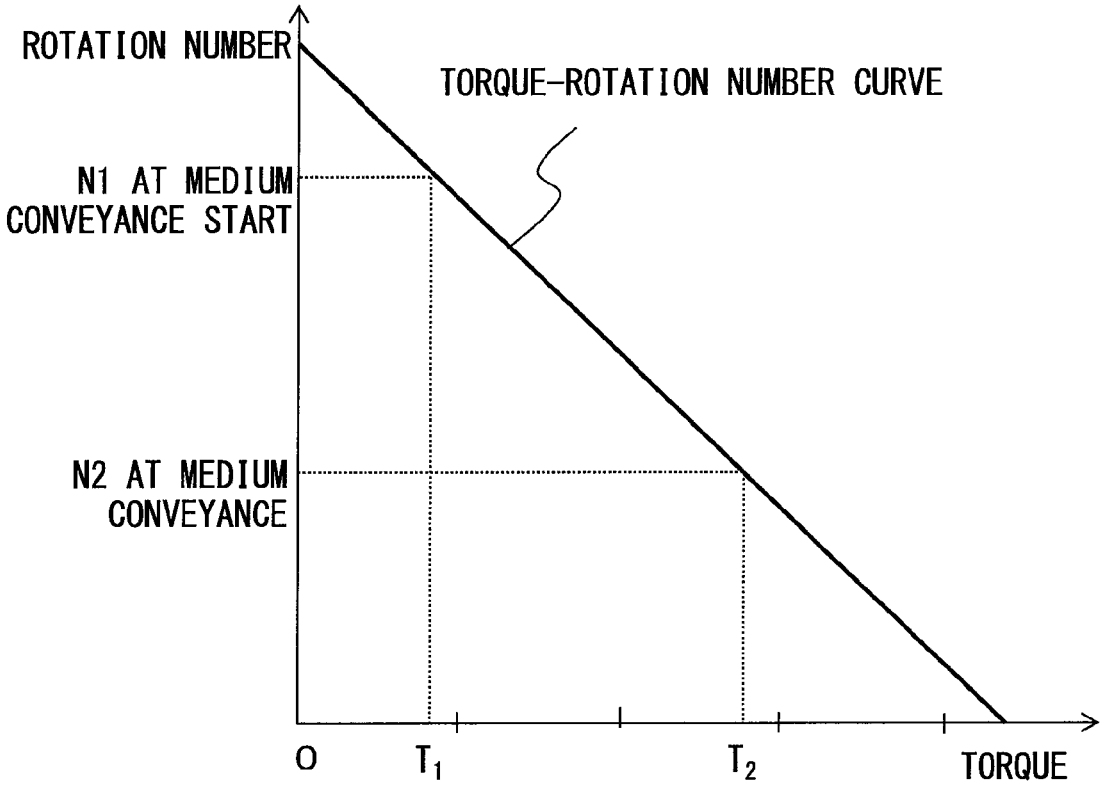
FIG. 2 illustrates a torque-rotation speed curve of a driving motor for driving a leading roller pair.

FIG. 2 illustrates a torque-rotation number curve when the driving motor 28 drives the leading roller pair 22, 22 with a constant current.

A driving method of the driving motor 28 is called constant torque driving (or constant current driving). With this method, only a constant current is applied to the motor and a speed control is not performed. Therefore, a servo circuit is not needed.

However, a torque that generates a tension lower than that generated by the conveying unit 17, and a rotation speed with no load are set to implement a characteristic such that a conveyance speed higher than a normal conveyance speed of the recording medium 12 is obtained.

For example, in FIG. 2, the driving motor 28 has a characteristic such that the load increases to a high level (high torque T2) since tensions are generated by the nip roller pair 18, 18 and the conveying unit 17 and the rotation speed of the driving motor 28 at that time is low (N2) when the recording medium 12 is conveyed.

In the meantime, when the driving motor 28 is activated after the recording medium 12 is once suspended, the driving motor 28 is imposed with almost no load (low torque T1) because the recording medium 12 sags before the leading roller pair 22, 22. Accordingly, the rotation speed of the driving motor 28 increases to a high rotation number N1 (rotation speed with no load), and the recording medium 12 is quickly conveyed to the cutting unit 20. When the sag of the recording medium 12 is removed, the tension generated by the conveying unit 17 is applied to the recording medium 12.

However, the tension (torque) generated by the driving motor 28 is set to a level lower than that of the conveying unit 17. Therefore, the leading roller pair 22, 22 maintains the normal conveyance speed pursuant to the recording medium 12.

In this embodiment, the driving motor 28 for driving the leading roller pair 22, 22 is assumed as constant torque driving. However, constant voltage driving may be available as long as a motor can implement a rotation number with no load and a torque having a predetermined characteristic.

Figure 3A:
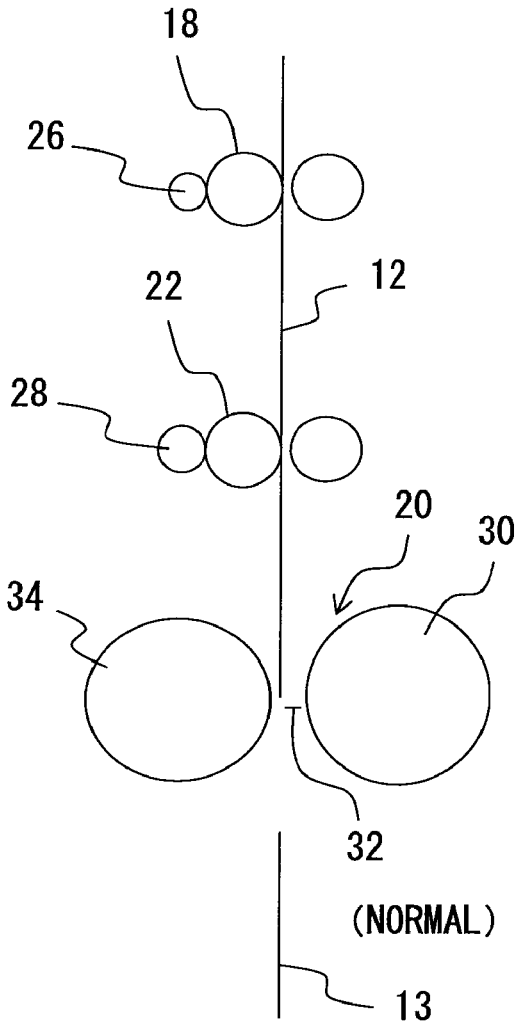
FIG. 3A is an explanatory view of outputting a paper sheet cut in a normal length.
Figure 3B:
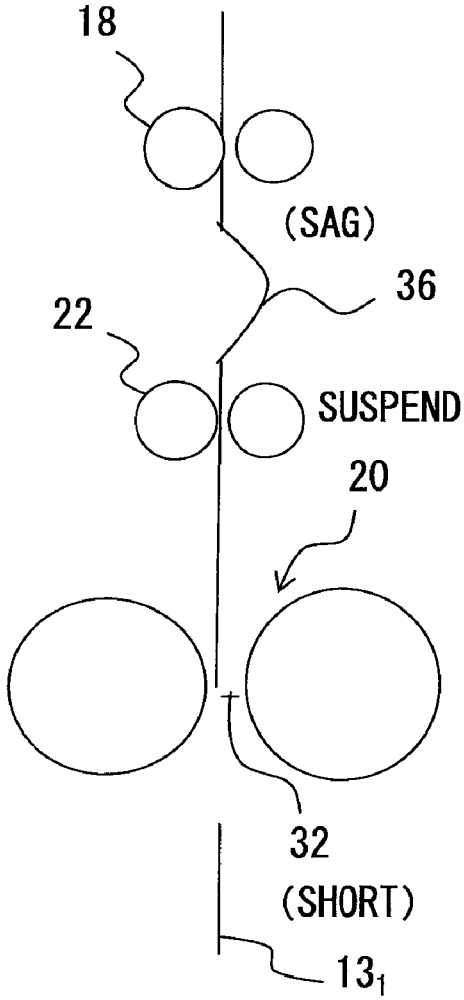
FIG. 3B is an explanatory view of outputting a paper sheet cut in a length shorter than a normal length in order to identify each job.
Figure 3C:
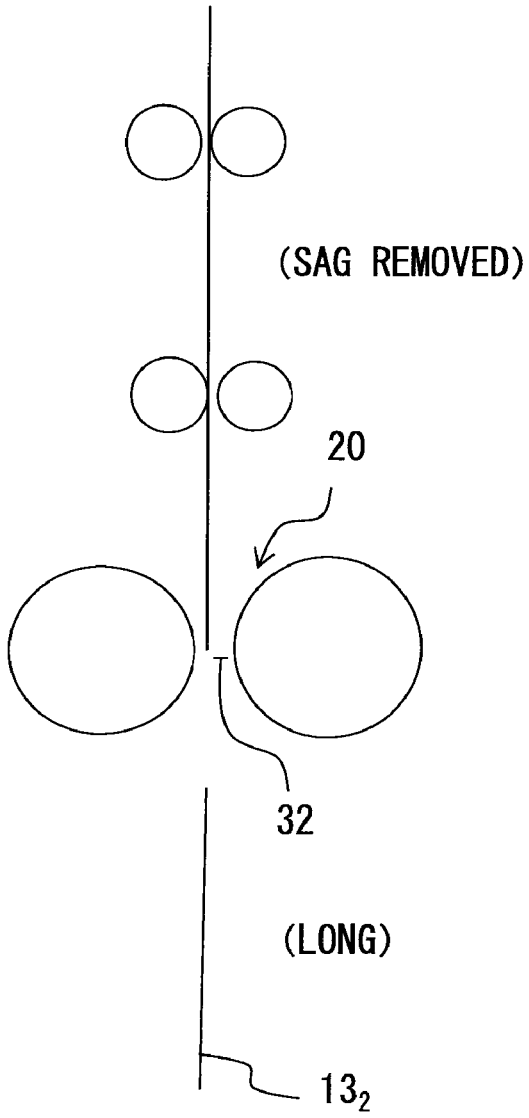
FIG. 3C is an explanatory view of outputting a paper sheet cut in a length longer than the normal length in order to identify each job.

FIGS. 3A to 3C are explanatory views of respectively outputting a paper sheet 13 cut in a normal length, a paper sheet $\mathbf{13}_1$ cut in a length shorter than a normal length, and a paper sheet $\mathbf{13}_2$ cut in a length longer than the normal length.

As illustrated in FIG. 3A, the driving motor 28 for driving the leading roller pair 22, 22 continues to rotate according to the conveyance speed, stipulated by the nip roller pair 18, of the recording medium 12 while an image is being recorded on the recording medium 12 based on job information transmitted from the higher-order device (not illustrated). This is because the rotation torque of the driving motor 28 for driving the leading roller pair 22, 22 is smaller than that of the driving motor 26 for driving the nip roller pair 18, 18 on a conveyance upstream side.

Here, the cut roller 30 and the anvil roller 34 have a high inertial force compared with the nip roller pair 18 and the like, and the cut roller 30 and the anvil roller 34 constantly rotate at a predetermined speed. The recording medium 12 is cut by being led between the cut roller 30 and the anvil roller 34. At this time, the recording medium 12 is cut in a length corresponding to a distance by which the recording medium 12 moves during a time that the cut roller 30 needs for one rotation.

Here, assume that the leading roller pair 22, 22 is controlled to be suspended or decelerated for a predetermined duration when one job is terminated. In this case, the amount of the recording medium 12 fed and led to the cutting unit 20 decreases in this suspension or deceleration duration. In contrast, the cut roller 30 and the anvil roller 34 rotate at the constant speed also in this duration. As a result, the recording medium 12 is cut into a short cut paper sheet $\mathbf{13}_1$ shorter than the predetermined length, and output from the cutting unit 20.

Additionally, the nip roller pair 18, 18 continues to convey the recording medium 12 also in this duration. As a result, the recording medium 12 stalls with a sag 36 bending between the nip roller pair 18, 18 and the leading roller pair 22, 22 as illustrated in FIG. 3B.

Thereafter, the leading roller pair 22, 22 is reactivated or accelerated. Then, the bending and sagging recording medium 12 is not influenced by the nip roller pair 18, 18 any more, and the driving motor 28 of the leading roller pair 22, 22 is temporarily imposed with an extremely light load. Accordingly, the driving motor 28 rotates at high speed based on the above described torque-rotation speed characteristic of FIG. 2 until the sag of the recording medium 12 is removed. As a result, the leading roller pair 22, 22 feeds, to the cutting unit 20 side, the recording medium 12 with an extra length equivalent to the sag portion 36.

As a result, the recording medium 12 is cut into a long cut paper sheet $\mathbf{13}_2$ longer than the normal length as illustrated in FIG. 3C, and output from the cutting unit 20.

A specific example of this embodiment is described next.

Assuming that the conveyance speed V of the continuous recording medium 12 is 20 m/min, the normal length L of a cut paper sheet is 200 mm, the number of paper sheets cut per minute is 20 m÷200 mm=100 sheets, a cycle t of the cut blade 32 is t=60 sec÷100 sheets=0.6 sec, a length of a separation page of a job is L±Δ, and Δ is 20 mm, a suspension time t2 of the leading roller pair 22, 22 results in t2=t (Δ÷L)=0.06 sec.

Figure 4:
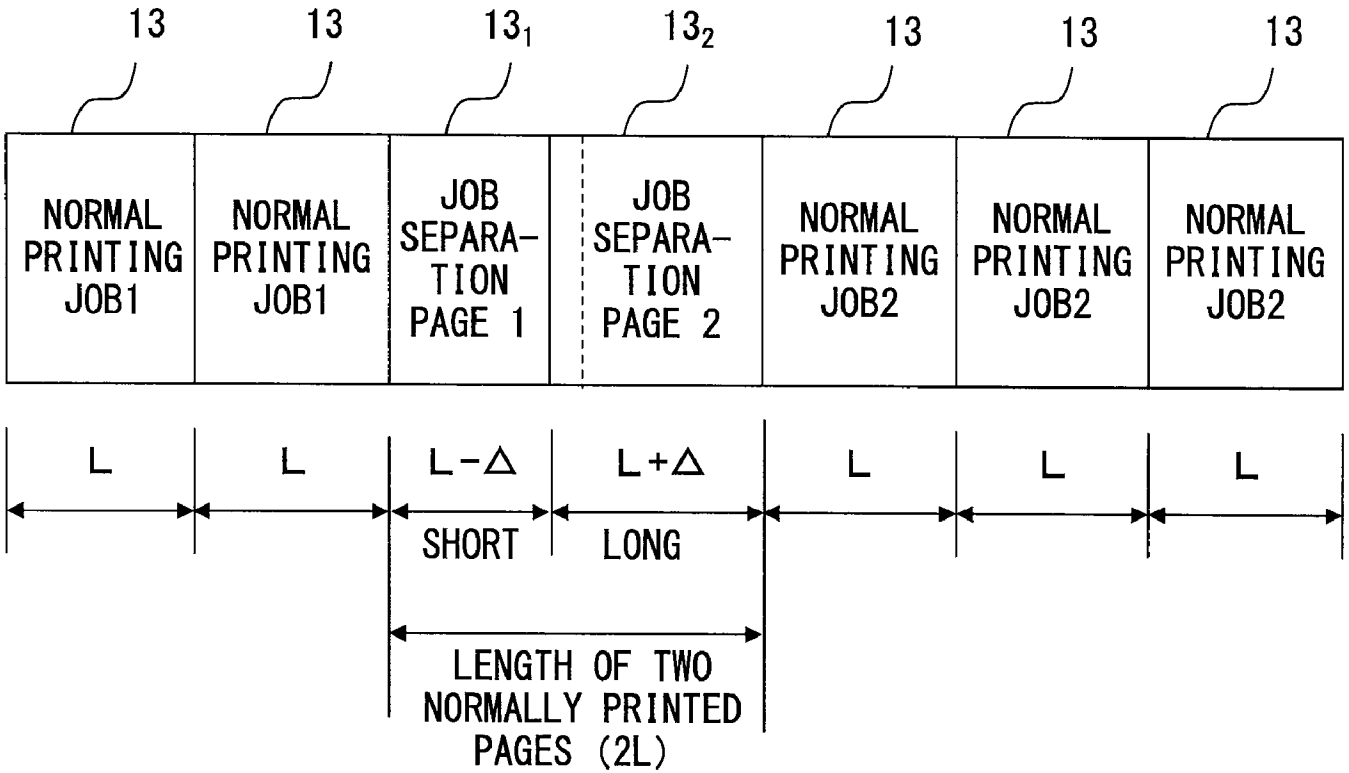
FIG. 4 illustrates respective lengths of cut paper sheets ejected in a paper stacker.

FIG. 4 illustrates respective lengths of cut paper sheets 31 ejected in the paper stacker 24.

In this embodiment, a short cut sheet $\mathbf{13}_1$ and a long cut sheet $\mathbf{13}_2$ as separation pages are ejected between JOB 1 and JOB 2. Assuming that the length of the normal cut sheet 13 is L, the length of the short cut sheet $\mathbf{13}_1$ is L−Δ shorter than the normal length, and the length of the long cut sheet $\mathbf{13}_2$ is L+Δ longer than the normal length as a result of the above described process. These short and long cut sheets $\mathbf{13}_1$ and $\mathbf{13}_2$ are configured as a set. With the short cut sheet $\mathbf{13}_1$ and the long cut sheet $\mathbf{13}_2$, a boundary between JOB 1 and JOB 2 is identified.

As described above, the conveyance speed of the recording medium 12 is stipulated by the nip roller pair 18. Accordingly, the rotation speed of the cut roller 30 and the anvil roller 34 is determined to be synchronous with the nip roller pair 18, 18. Accordingly, the recording medium 12 on which an image is recorded based on job information is normally cut in a predetermined length. Even while the short cut sheet $\mathbf{13}_1$ and the long cut sheet $\mathbf{13}_2$ are being output, the linear speed of the nip roller pair 18 (namely, the conveyance speed of the recording medium 12) and that of the cut roller 30 and the anvil roller 34 are equal to those when an image is recorded in a normal job.

If the duration of suspending or decelerating the rotation of the leading roller pair 22 is shorter than a time needed to convey one normally printed sheet, and if also a time needed to reactivate or accelerate the leading roller pair 22 is shorter than the time needed to convey one normally printed sheet, the length of the total of the short cut sheet $\mathbf{13}_1$ and the long cut sheet $\mathbf{13}_2$ as a set is equivalent to a length (2L) of two normally printed sheets.

A ratio of the length of the short cut sheet $\mathbf{13}_1$ to that of the long cut sheet $\mathbf{13}_2$ can be adjusted by changing the duration of suspending or decelerating the leading roller pair 22. In this way, the total of the lengths of the short cut sheet $\mathbf{13}_1$ and the long cut sheet $\mathbf{13}_2$ can be made equal to the length of L2, L3, . . . when they are cut.

FIGS. 5A to 5F illustrate timing charts of this embodiment.

Figure 5:
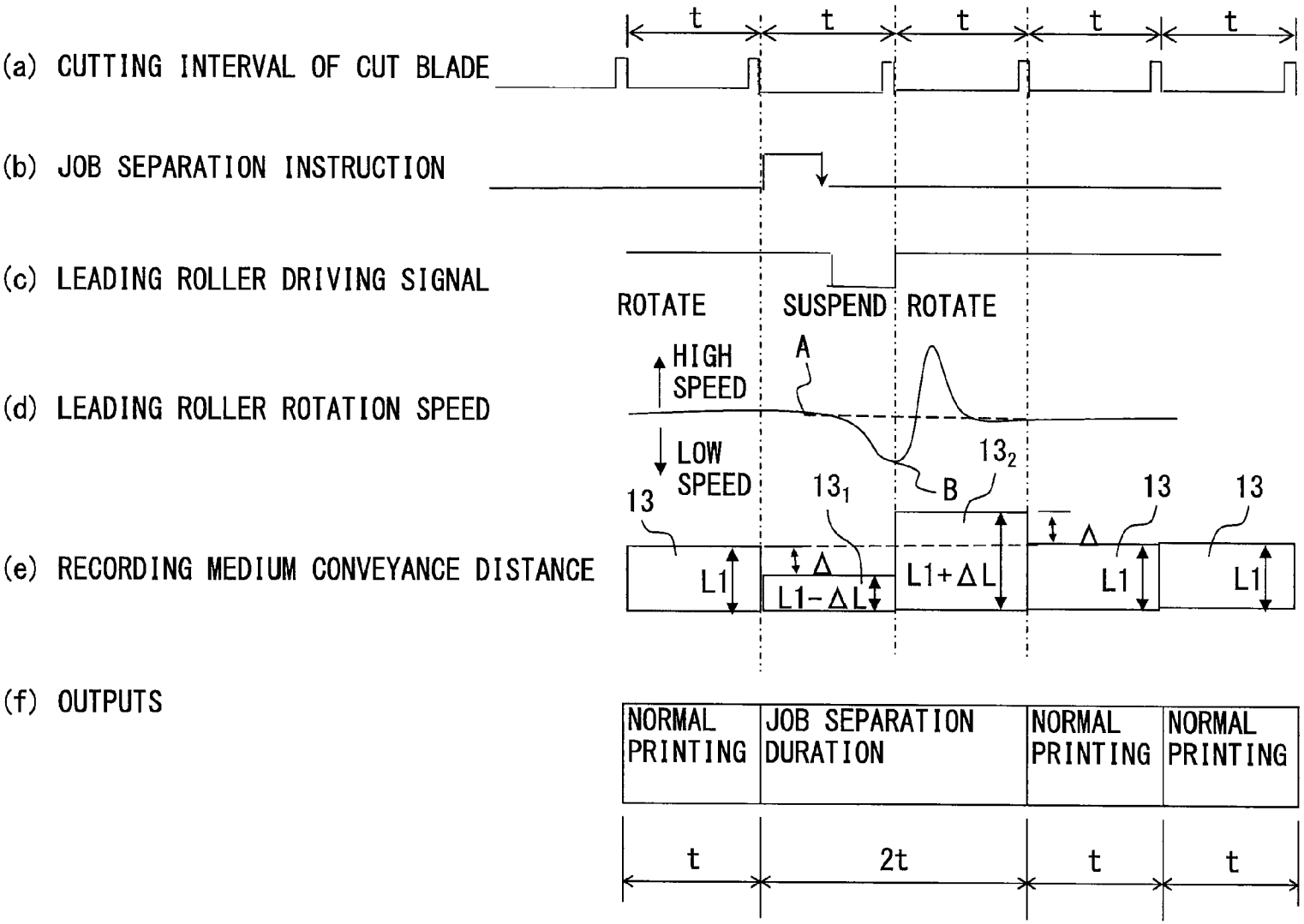
FIGS. 5A to 5F illustrate timing charts in this embodiment.

FIG. 5A illustrates the rotation cycle t of the cut roller 30 that rotates at a constant speed. Namely, the recording medium 12 is cut with the cut blade 32 provided on the outer perimeter each time the cut roller 30 rotates.

When the controlling unit 25 of the image recording apparatus 10 issues a job separation instruction as illustrated in FIG. 5B, a leading roller driving signal for suspending the leading roller pair 22, 22 is output at a falling edge of the signal as illustrated in FIG. 5C.

Then, the rotation of the leading roller pair 22, 22 is decelerated at a point A and suspended at a point B as illustrated in FIG. 5D. As a result, as illustrated in FIG. 3B the sag portion 36 is formed on the recording medium 12 between the nip roller pair 18, 18 and the leading roller pair 22, 22.

Accordingly, the amount of the recording medium 12 led to the cutting unit 20 decreases (L−Δ) as illustrated in FIG. 5E. However, since the cut roller 30 rotates at the constant speed, the recording medium 12 is cut in the length (L−Δ) shorter than the normal length L. At the next moment when the leading roller driving signal makes a transition from "suspend" to "rotate", the driving motor 28 of the leading roller pair 22, 22 starts to activate. At this time, the sag portion 36 of the recording medium 12 exists on the upstream side of the leading roller pair 22, 22. Accordingly, the load on the driving motor 28 is extremely reduced, whereby the driving motor 28 rotates at a high speed (see FIG. 5D).

As a result, the amount of the recording medium 12 led to the cutting unit 20 increases (L+Δ). Since the cut roller 30 rotates at the constant speed, the recording medium 12 is cut in the length (L+Δ) longer than the normal length L (see FIG. 5E). When the sag portion 36 of the recording medium 12 is removed, the recording medium 12 is cut in the normal length L thereafter.

FIG. 5F illustrates a state where ejected cut sheets 13 are arranged in time series. Namely, the normal cut sheet 13 is cut at the cycle t, whereas both the short cut sheet $\mathbf{13}_1$ and the long cut sheet $\mathbf{13}_2$ are cut at a cycle 2*t* in a job separation duration.

Figure 6:
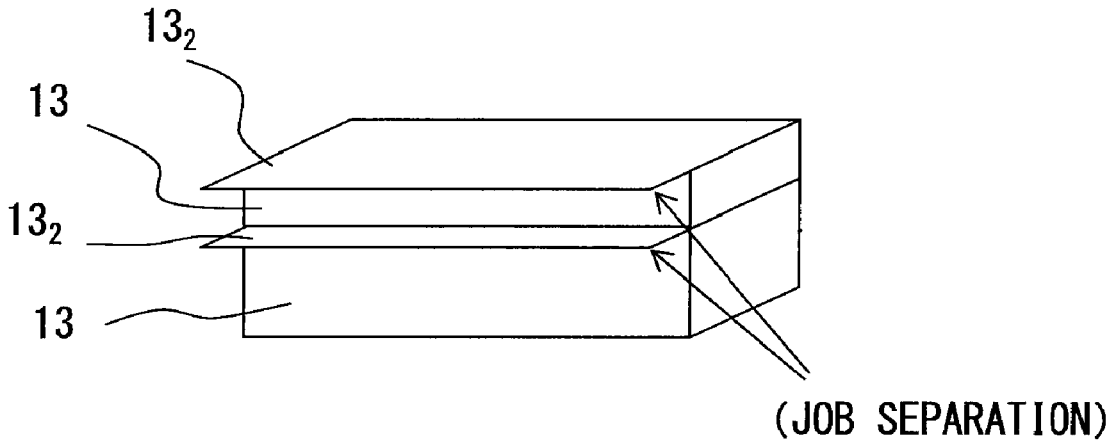
FIG. 6 illustrates paper sheets ejected and stacked in the paper stacker.

FIG. 6 illustrates many paper sheets ejected and stacked in the paper stacker 24.

Long cut sheets $\mathbf{13}_2$ are proved to protrude from among a plurality of paper sheets in the conveyance direction.

Therefore, an operator can easily identify a break of one job based on the portions of the long cut sheets $\mathbf{13}_2$ even if many paper sheets are stacked.

Figure 7:
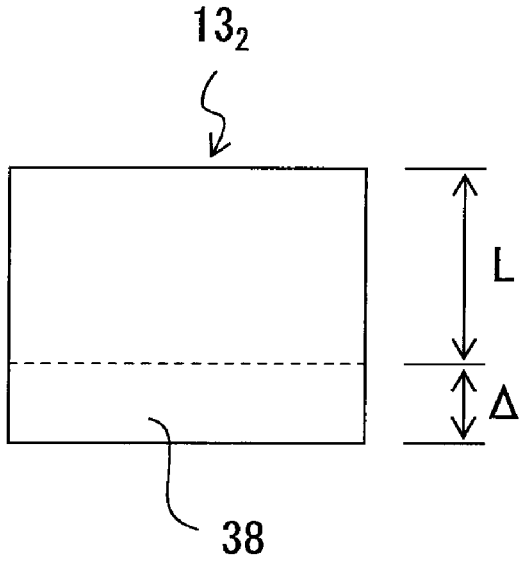
FIG. 7 illustrates a state where a mark is put on a short portion of a long cut paper sheet in a conveyance direction.

FIG. 7 illustrates a state where a mark 38 is put on an end portion of the long cut sheet $\mathbf{13}_2$ in the conveyance direction.

This mark 38 is recorded, for example, in M color. However, the mark 38 may be recorded in the entire area of the long cut sheet $\mathbf{13}_2$.

Not only by changing the length of a paper sheet but, for example, by tinting a color in a predetermined area as described above, a break of one job can be securely identified.

Figure 8:
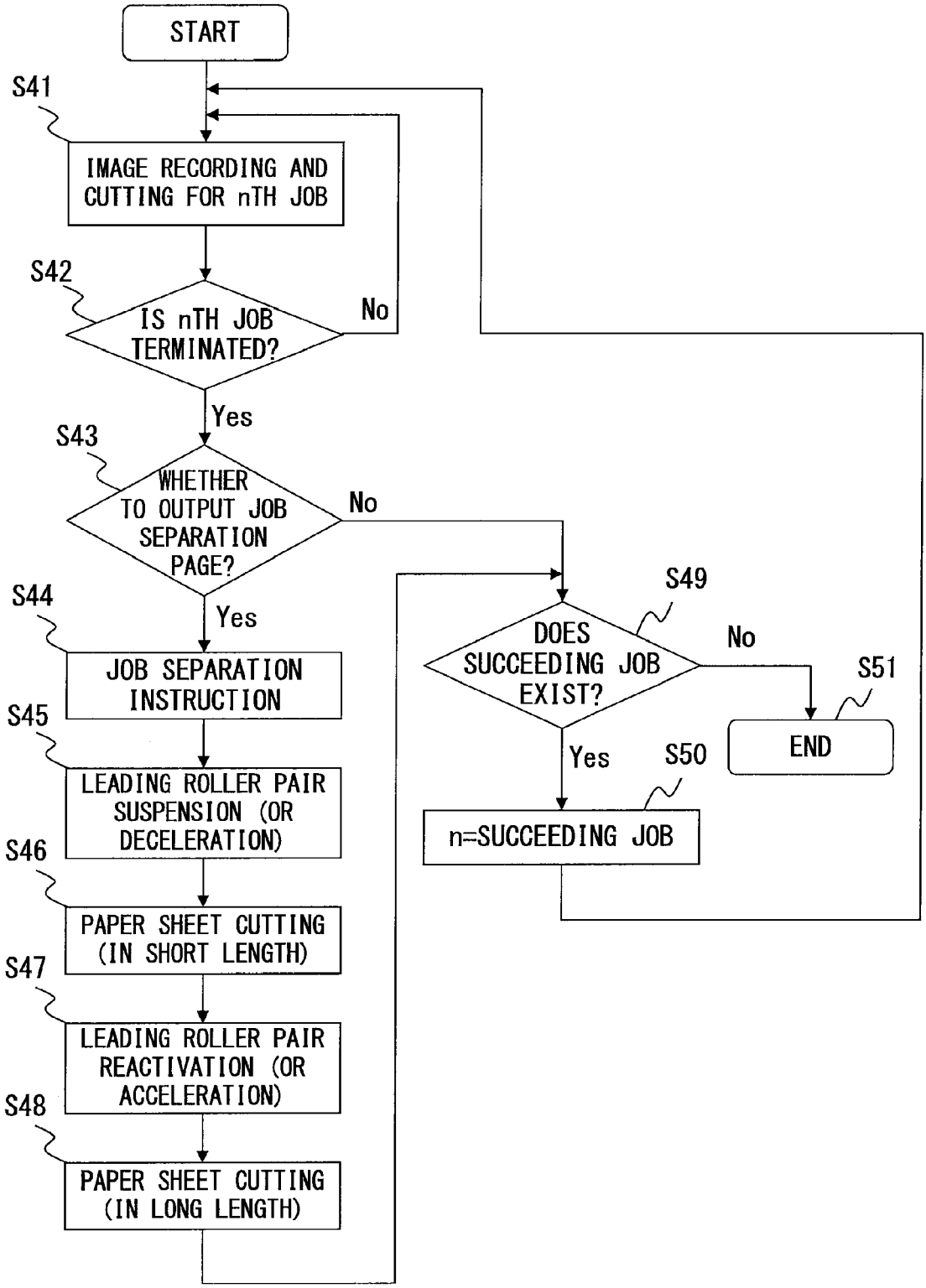
FIG. 8 is a flowchart of a process executed in this embodiment.

FIG. 8 is a flowchart of a process executed in this embodiment.

When the higher-order device issues an image recording instruction and a cut instruction for an nth job in step S41 (hereinafter referred to as S41 and the like), whether or not the nth job is terminated is determined in S42. If the determination results in "NO" (not terminated), the flow goes back to S41. If the determination results in "YES" (terminated), the flow goes to S43.

In S43, whether or not to output a separation page of the job is determined. If the determination results in "NO", the flow goes to S49. If the determination results in "YES", the flow goes to S44. Namely, if the instruction issued from the higher-order device includes information for attaching a separation page, the flow goes to S44. Otherwise, the flow goes to S49.

In S44, a job separation instruction is issued. In S45, the leading roller pair 22, 22 is suspended (or decelerated). As a result, the sag portion 36 is caused on the recording medium 12. Therefore, a short sheet $\mathbf{13}_1$ is cut by the cutting unit 20 in S46. Next, the leading roller pair 22, 22 is reactivated (or accelerated) at predetermined timing in S47. As a result, the sag portion 36 of the recording medium 12 is led to the cutting unit 20 at a high speed, and a long sheet $\mathbf{13}_2$ is thereafter cut by the cutting unit 20 in S48.

Then, in S49, whether or not a succeeding job exists is determined. If the determination results in "NO" (does not exist), the process is terminated in S51. If the determination results in "YES" (exists), the process is restarted at the first step S41 by recognizing the succeeding job as "n".

This embodiment refers to the case where the short cut sheet $\mathbf{13}_1$ and the long cut sheet $\mathbf{13}_2$ are cut by controlling the operations of the leading roller pair 22,22. However, an embodiment of the present invention is not limited to this one. The same objective can be achieved, for example, by changing the rotation speed of the cut roller 30.

However, solidity of the cut blade 32 needs to be improved in order to withstand a shock and the like at the time of cutting. Accordingly, the cut roller 30 and the anvil roller 34 are structured to have a high inertia moment.

To variably control the speed of the cut roller 30 in a short time, a powerful driving motor is needed. Moreover, since a speed control using a servo is essential to the cut roller 30 for a precise alignment, the control becomes more complex. Considering these prerequisites, the short cut sheet $\mathbf{13}_1$ and the long cut sheet $\mathbf{13}_2$ are enabled to be cut with a simpler method in this embodiment.

According to this embodiment, the leading roller pair 22 is temporarily suspended or decelerated to reduce the amount of the recording medium 12 led to the cutting unit 20 while the recording medium 12 is being conveyed, and the recording medium 12 is led to the cutting unit 20 so that the recording medium 12 can be cut into a short cut sheet $\mathbf{13}_1$ shorter than a normal length. Furthermore, the leading roller pair 22 is thereafter reactivated or accelerated at predetermined timing, and the recording medium 12 is led to the cutting unit 20 so that the recording medium 12 can be cut into a long cut sheet $\mathbf{13}_2$ longer than the normal length. The cut sheet $\mathbf{13}_2$ longer than the normal length is output at a break of one job in this way, whereby the break of one job can be identified at a glance.

What is claimed is:

1. An image recording apparatus, comprising:

a conveying unit for conveying a continuous medium, on which an image is recorded by an image recording unit, with a predetermined tension and speed;

a cutting unit having a cutting side rotator and a receiving side rotator, which are arranged to face each other in order to be able to cut the continuous medium and rotate with a predetermined rotation speed;

a leading unit having a pair of leading rotators that are arranged between the conveying unit and the cutting unit and nip and lead the continuous medium to the cutting unit; and a controlling unit for performing a control for temporarily suspending or decelerating the pair of leading rotators to temporarily reduce an amount of the continuous medium led to the cutting unit, for leading the continuous medium in a size of a short cut paper sheet shorter than a normal cut size, for thereafter reactivating or accelerating the pair of leading rotators at predetermined timing to increase the amount of the continuous medium led to the cutting unit, and for leading the continuous medium in a size of a long cut paper sheet longer than the normal cut size.

2. The image recording apparatus according to claim 1, wherein the pair of leading rotators has a driving motor, a torque of the driving motor is set so that a tension smaller than a tension generated by the conveying unit is generated, and a conveyance speed when the driving motor rotates with no load is higher than a normal conveyance speed.

3. The image recording apparatus according to claim 1, wherein a total of lengths of the short cut paper sheet and the long cut paper sheet is a length equivalent to lengths of two normal cut paper sheets or to a length of an integer multiple of the normal cut paper sheet.

4. The image recording apparatus according to claim 1, wherein the image recording unit puts a mark on at least an end portion of the long cut paper sheet on an upstream or downstream side of a conveyance direction.

5. A controlling method of an image recording apparatus, comprising:

a conveying step of conveying a continuous medium, on which an image is recorded by an image recording unit, with a predetermined tension and speed;

a cutting step of cutting the continuous medium with a cutting side rotator and a receiving side rotator, which are arranged to face each other in order to be able to cut the continuous medium and rotate with a predetermined rotation number; and a leading step of nipping and leading the continuous medium to a cutting unit with a pair of leading rotators that are arranged between a conveyance position in the conveying step and a cut position in the cutting step, wherein the pair of leading rotators is temporarily suspended or decelerated to temporarily reduce an amount of the continuous medium led to the cutting unit, the continuous medium is led and cut in a size of a short cut paper sheet shorter than a normal cut size, the pair of leading rotators is thereafter reactivated or accelerated at predetermined timing to increase the amount of the continuous medium led to the cutting unit, and the continuous medium is led and cut in a size of a long cut paper sheet longer than the normal cut size.

6. The controlling method according to claim 5, wherein the pair of leading rotators has a driving motor, a torque of the driving motor is set so that a tension smaller than a tension generated by the conveying step is generated, and a conveyance speed when the driving motor rotates with no load is higher than a normal conveyance speed.

7. The controlling method according to claim 5, wherein a total of lengths of the short cut paper sheet and the long cut paper sheet is a length equivalent to lengths of two normal cut paper sheets or to a length of an integer multiple of the normal cut paper sheet.

8. The controlling method according to claim 5, wherein the image recording unit puts a mark on at least an end portion of the long cut paper sheet on an upstream or downstream side of a conveyance direction.

* * * * *